US007515129B2

(12) United States Patent
Jeoung et al.

(10) Patent No.: US 7,515,129 B2
(45) Date of Patent: Apr. 7, 2009

(54) LIQUID CRYSTAL DISPLAY AND METHOD OF DRIVING THE SAME

(75) Inventors: Hun Jeoung, Kyoungsangbuk-do (KR); Hong Soo Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 607 days.

(21) Appl. No.: 10/721,250

(22) Filed: Nov. 26, 2003

(65) Prior Publication Data

US 2008/0170017 A1 Jul. 17, 2008

(30) Foreign Application Priority Data

Dec. 6, 2002 (KR) ..... 10-2002-0077378

(51) Int. Cl.
*G09G 3/36* (2006.01)

(52) U.S. Cl. ..... 345/87; 345/94

(58) Field of Classification Search ..... 345/87–104
See application file for complete search history.

(56) References Cited

U.S. PATENT DOCUMENTS 5,598,180 A * 1/1997 Suzuki et al. ..... 345/100
5,694,145 A * 12/1997 Kondo et al. ..... 345/90
5,764,207 A * 6/1998 Maekawa et al. ..... 345/99
6,160,535 A * 12/2000 Park ..... 345/88
6,515,646 B2 * 2/2003 Tokonami et al. ..... 345/96
7,002,563 B2 * 2/2006 Nakamura ..... 345/204

FOREIGN PATENT DOCUMENTS

KR 2001-60272 7/2001
KR 2002-79156 10/2002

* cited by examiner

*Primary Examiner*—Jimmy H Nguyen
(74) *Attorney, Agent, or Firm*—McKenna Long & Aldridge LLP

(57) ABSTRACT

A liquid crystal display (LCD) device and a method of driving the same applies dummy pixel signals each representing a substantially identical brightness level during a blanking period, wherein the horizontal stripe phenomenon is substantially prevented from being generated due to differences in capacitive coupling between liquid crystal cells and adjacent data line.

16 Claims, 6 Drawing Sheets

LIQUID CRYSTAL DISPLAY AND METHOD OF DRIVING THE SAME

This application claims the benefit of the Korean Patent Application No. 2002-77378 filed on Dec. 6, 2002, which is hereby incorporated by reference for all purposes as if fully set forth herein.

BACKGROUND OF THE INVENTION

1. Field of the Invention

The present invention relates to liquid crystal display (LCD) devices. More particularly, the present invention relates to a LCD device and a method of driving the same, wherein generation of a horizontal stripe phenomenon may be prevented.

2. Description of the Related Art

Generally, liquid crystal display (LCD) devices control light transmittance characteristics of liquid crystal material in accordance with applied electric fields. Accordingly, LCD devices typically include an LCD panel having a plurality of liquid crystal cells arranged in a matrix pattern, and drive circuits to drive the plurality of liquid crystal cells.

FIG. 1 illustrates a related art liquid crystal display (LCD) device.

Referring to FIG. 1, the related art includes an LCD panel 12 having a plurality of liquid crystal cells 20 arranged in a matrix pattern, a gate diver 14 for driving a plurality of gate lines GL1 to GLn, a data driver 16 for driving a plurality of data lines DL1 to DLm, and a timing controller 18 for controlling the gate and data drivers 14 and 16, respectively. The LCD panel 12 further includes a plurality of thin film transistors (TFTs) formed at crossings of the plurality of gate and data lines GL1 to GLn and DL1 to DLm, respectively, wherein each of the TFTs is connected to a corresponding liquid crystal cell 20.

Upon driving the plurality of liquid crystal cells 20, the gate driver 14 sequentially applies scan signals to the plurality of gate lines GL1 to GLn to sequentially drive rows of liquid crystal cells 20. Accordingly, the scan signals include gate high and low voltages (VGH) and (VGL), respectively. Whenever the gate high voltage (VGH) is applied to a gate line (GL), TFTs within the driven row of liquid crystal cells are turned on and pixel signals, applied by the data driver 16 to each of the data lines DL1 to DLm, are transmitted to the driven row of liquid crystal cells 20. Whenever the gate low voltage (VGL) is applied to a gate line (GL), TFTs within the driven row of liquid crystal cells 20 are turned off, wherein a voltage corresponding to a pixel signal remains charged within the liquid crystal cell 20.

Each liquid crystal cell 20 can be equivalently represented as a liquid crystal capacitor (Clc) including a common electrode capacitively coupled to a pixel electrode by liquid crystal material having anisotropic dielectric properties, wherein the pixel electrode is connected to a TFT. Each liquid crystal cell 20 further includes a storage capacitor (Cst) formed between a pixel electrode and a pre-stage gate line for retaining a voltage associated with a pixel signal until a subsequent pixel signal is charged to the liquid crystal cell 20. Once a pixel signal is applied from a data line (DL), a turned-on TFT applies a voltage associated with the pixel signal to the pixel electrode to generate electric field between the pixel and common electrodes. In response to the generated electric field, a molecular orientation of the liquid crystal material is manipulated such that light transmittance characteristics of the liquid crystal cell are controlled. Moreover, gray scale values of light are realized by the liquid crystal cell by adjusting the pixel signal voltage.

The gate driver 14 sequentially applies the gate high voltage (VGH) to the plurality of gate lines GL1 to GLn in response to gate control signals (GSP, GSC, GOE) outputted from the timing controller 18. More specifically, the gate driver 14 generates a shift pulse by shifting a gate start pulse (GSP) in accordance with a gate shift pulse (GSC). Next, the gate driver 14 applies the gate high voltage (VGH) to a predetermined gate line (GL) during each horizontal period in response to the gate shift pulse (GSC). During operation, the gate driver 14 applies the gate high voltage (VGH) only during an enable period of a gate output enable signal (GOE). During periods of time when the gate high voltage (VGH) is not applied, however, the gate driver 14 applies the gate low voltage (VGL) to the gate lines GL1 to GLn.

The data driver 16 applies pixel signals, specific for each gate line to which the gate high voltage (VGH) is applied, simultaneously to each of the data lines DL1 to DLm in response to data control signals (SSP, SSC, SOE, POL) outputted from the timing controller 18. More specifically, the data driver 16 generates a sampling signal by shifting a source start pulse (SSP) in accordance with a source shift clock (SSC). Next, the data driver 16 sequentially receives and latches digital pixel data (R,G,B) outputted from the timing controller 18 in response to the sampling signal. The data driver 16 then converts the digital pixel data (R,G,B), latched in correspondence with the gate line to which the gate high voltage (VGH) is applied, into analog pixel signals and applies the analog pixel signals to the data lines DL1 to DLm during the enable period of the source output enable signal (SOE). More specifically, the data driver 16 converts the digital pixel data (R,G,B) into analog pixel signals using gamma signals outputted from a gamma voltage generator (not shown). The data driver 16 also converts the digital pixel data (R,G,B) into positive and negative polarity pixel signals in response to a polarity control signal (POL). For example, in response to the polarity control signal (POL), the data driver 16 inverts the polarity of the pixel signal based on a columnar arrangement of the liquid crystal cells 20 to drive the liquid crystal display panel 12 according to a dot inversion system.

As mentioned above, the timing controller 18 controls the gate and data drivers 14 and 16 by generating the gate control signals (GSP, GSC, GOE) and the data control signals (SSP, SSC, SOE, POL), respectively. Additionally, the timing controller 18 arranges the pixel data (R,G,B) and applies the arranged digital pixel data to the data driver 16.

As described above, liquid crystal cells 20 within the related art LCD display can be driven using an inversion driving method such as a frame inversion, line (column) inversion, or dot inversion method to improve a picture quality of the LCD device. Compared to other inversion driving methods, the dot inversion driving method provides an excellent picture quality. However, and as shown with reference to FIG. 2, use of the dot inversion driving method can generate defects, such as horizontal stripes, within the LCD panel 12. As described in greater detail below, the horizontal stripe phenomenon occurs due to the presence of first and second parasitic capacitors Cdp1 and Cdp2 formed between pixel electrodes 20 of liquid crystal cells A and B and preceding and succeeding ones of adjacent data lines (e.g., data lines DLk and DLk+1).

The horizontal stripe phenomenon, generated when the liquid crystal display panel is driven according to the dot inversion driving method, will now be explained in greater detail with reference to FIGS. 3 to 5.

FIG. 3 illustrates charging characteristics of vertically adjacent liquid crystal cells with respect to pixel signals applied to the $k^{th}$ data line shown in FIG. 2. FIG. 4 illustrates charging characteristics of vertically adjacent liquid crystal cells with respect to pixel signals applied to the $(k+1)^{th}$ data line shown in FIG. 2. FIG. 5 illustrates charging characteristics of vertically adjacent liquid crystal cells with respect to pixel signals applied to the $k^{th}$ and $(k+1)^{th}$ data lines shown in FIG. 2.

Referring to FIGS. 2 to 5, during a first horizontal period, a first pixel signal (−Vp), having a negative polarity (−) with respect to the common voltage Vcom, is applied to the kth data line (DLk) while a first pixel signal (+Vp), having a positive polarity (+) with respect to the common voltage Vcom is applied to the $(k+1)^{th}$ data line (DLk+1). The brightness level represented by the first positive polarity pixel signal (+Vp) is relatively higher than the brightness level represented by the first negative polarity pixel signal (−Vp). Simultaneously with the application of the first negative and positive polarity pixel signals −Vp and +Vp, a first thin film transistor (TFT1), connected to the first gate line (GL1), is turned on in response to a scan pulse (not shown) applied to the first gate line (GL1). Accordingly, a first negative pixel voltage Vp1, associated with the first negative polarity pixel signal (−Vp), is charged to the first liquid crystal cell (A) connected to the first gate line (GL1) from the kth data line (DLk).

Subsequently, during a second horizontal period (H2), a second pixel signal (+Vp), having a positive polarity (+) with respect to the common voltage Vcom, is applied to the kth data line (DLk) while a second pixel signal (−Vp), having a negative polarity (−) with respect to the common voltage Vcom is applied to the $(k+1)^{th}$ data line (DLk+1). The brightness level represented by the second negative polarity pixel signal (−Vp) is relatively higher than the brightness level represented by the second positive polarity pixel signal (+Vp). Simultaneously with the application of the second positive and negative polarity pixel signals +Vp and −Vp, a second thin film transistor (TFT2), connected to the second gate line (GL2), is turned in response to a scan pulse (not shown) applied to the second gate line (GL2). Accordingly, a second positive pixel voltage Vp2, associated with the second positive polarity pixel signal (+Vp), is charged to the second liquid crystal cell (B), connected to the second gate line (GL2), from the $k^{th}$ data line (DLk).

As a result of driving the related art LCD panel as described above, the first negative pixel voltage Vp1 is capacitively affected by the second positive polarity pixel signal (+Vp) applied to the $k^{th}$ data line (DLk) via the first parasitic capacitor (Cdp1) and by the second negative polarity pixel signal −Vp applied to the $(k+1)^{th}$ data line (DLk+1) via the second parasitic capacitor (Cdp2) during the second horizontal period (H2). Accordingly, a value of the first negative pixel voltage Vp1 changes during the second horizontal period (H2). Since an absolute value of the second negative polarity pixel signal −Vp applied to the $(k+1)^{th}$ data line (DLk+1) is relatively large, the capacitance of the second parasitic capacitor (Cdp2) is also relatively large, thereby increasing the magnitude of the first negative pixel voltage Vp1 within the first liquid crystal cell (A).

Moreover, during a third horizontal period (H3), a third negative polarity pixel signal (−Vp) is applied to the $k^{th}$ data line (DLk) to charge a third liquid crystal cell (not shown) while a third positive polarity pixel signal (+Vp) is applied to the $(k+1)^{th}$ data line (DLk+1). The brightness level represented by the third positive polarity pixel signal (+Vp) is relatively higher than the brightness level represented by the third negative polarity pixel signal (−Vp). Accordingly, the first negative pixel voltage Vp1 and the second positive pixel voltage Vp2 are both capacitively affected by the third negative and positive polarity pixel signals −Vp and +Vp respectively applied to the $k^{th}$ and $(k+1)^{th}$ data lines (DLk) and (DLk+1), respectively, via the first and second parasitic capacitors Cdp1 and Cdp2, respectively, during the third horizontal period (H3). Accordingly, a value of the first negative and second positive pixel voltages Vp1 and Vp2 change during the third horizontal period (H3). Since an absolute value of the third positive polarity pixel signal +Vp applied to the $(k+1)^{th}$ data line (DLk+1) is relatively large, the capacitance of the second parasitic capacitor (Cdp2) is also relatively large, thereby positively decreasing the magnitude of the first negative pixel voltage Vp1 and positively increasing the magnitude of the second positive pixel voltage Vp2.

As can be seen from the discussion above, the various positive and negative polarity pixel signals, charged within each liquid crystal cell, capacitively affect existing positive and negative pixel voltages, previously charged via the $k^{th}$ and $(k+1)^{th}$ data lines (DLk) and (DLk+1) through the first and second parasitic capacitors Cdp1 and Cdp2 within each liquid crystal cell. Moreover, due to the presence of the aforementioned polarity control signals (POL) applied to the $k^{th}$ and $(k+1)^{th}$ data lines (DLk) and (DLk+1), the polarity of the capacitance within the parasitic capacitors (Cdp1 and Cdp2) is inverted during each horizontal period (H). As a result, the various pixel voltages charged within each liquid crystal cell can become offset.

During the data apply period (DAP) of a first frame (1F), pixel signals are applied to the $k^{th}$ and (k+1)th data lines (DLk and DLk+1) in accordance with the dot inversion method. Due to the aforementioned offset, changes in first and second effective voltages (EVa and EVb) of the first and the second liquid crystal cells A and B, respectively, are substantially the same.

During a blanking period (BP) succeeding the data apply period (DAP), however, the $k^{th}$ and $(k+1)^{th}$ data lines (DLk and DLk+1) are placed in a floating state wherein the first and second liquid crystal cells A and B are capacitively coupled with pixel signals applied during the $n^{th}$ horizontal period (Hn) of n number of horizontal periods. Accordingly, values of the first (negative) and second (positive) pixel voltages Vp1 and Vp2 associated with the $n^{th}$ horizontal period are maintained during the blanking period.

For example, during the $n^{th}$ horizontal period, an $n^{th}$ negative pixel signal is applied to the $k^{th}$ data line (DLk) while an $n^{th}$ positive pixel signal is applied to the (k+1)th data line (DLk+1). The brightness level represented by the $n^{th}$ positive polarity pixel signal (+Vp) is relatively higher than the brightness level represented by the $n^{th}$ negative polarity pixel signal (−Vp). Accordingly, the nh negative and positive pixel signals are applied to the $k^{th}$ and $(k+1)^{th}$ data lines (DLk and DLk+1), respectively, during the blanking period (BP). As a result, the first (negative) and second (positive) pixel voltages Vp1 and Vp2 are capacitively affected by the $n^{th}$ pixel signals. More specifically, the magnitude of the first negative pixel voltage Vp1 is positively decreased a first amount due to the first parasitic capacitor (Cpd1) while the magnitude of the first negative pixel voltage Vp1 is negatively increased a second amount, greater than the first amount, due to the second parasitic capacitor (Cpd2). Further, the magnitude of the positive pixel voltage Vp2 is negatively decreased a first amount due to the first parasitic capacitor (Cpd1) while the magnitude of the first negative pixel voltage Vp1 is positively increased a second amount, greater than the first amount, due to the second parasitic capacitor (Cpd2). Since an absolute value of the first negative pixel voltage (Vp1) decreases during the blanking period (BP) while an absolute value of the second positive pixel voltage (Vp2) increases during the blanking period (BP), the intensity to which the first liquid crystal cell (A) transmits light differs compared to the intensity to which the second liquid crystal cell (B) transmits light.

Based on the values of the pixel signals Vp applied to the first and second liquid crystal cells (A) and (B) via the $k^{th}$ data line DLk, and based on the first (negative) and second (positive) pixel voltages Vp1 and Vp2, respectively, charged within the first and second liquid crystal cells (A) and (B), respectively, during the blanking period (BP), the effective pixel voltages EVa and EVb of the first and second liquid crystal cells (A) and (B), respectively, are determined by the following equations:

$$EVa=(1-t)\times Vp+t\times Vp1$$

$$EVb=(1-t)\times Vp+t\times Vp2,$$

wherein t represents the duration of the blanking period (BP) within of one frame period (1F) and (1−t) represents the duration of the data apply period (DAP) within one frame period (1F).

Accordingly, the intensity to which an $i^{th}$ horizontal having the first liquid crystal cell (A) line transmits light differs compared to the intensity to which an $(i+1)^{th}$ horizontal line having the second liquid crystal cell (B) transmits light during the blanking period (BP) and the horizontal stripe phenomenon is generated.

Referring to FIG. 6, the effect of the horizontal stripe phenomenon is similar to the effect of displaying a green (G) pattern along a vertical direction. Accordingly, the picture quality in the related art LCD device is deteriorated. Moreover, the effect of the horizontal stripe phenomenon becomes more apparent as the duration of the blanking period within the frame increases, as the difference between absolute values of the pixel signals supplied to adjacent ones of data lines increases, and as differences in the capacitance values of the first and second parasitic capacitors Cdp1 and Cdp2 increases.

SUMMARY OF THE INVENTION

Accordingly, the present invention is directed to a liquid crystal display and a method of driving the same, wherein generation of the horizontal stripe phenomenon may be prevented, that substantially obviates one or more of the problems due to limitations and disadvantages of the related art.

An advantage of the present invention provides a dummy pixel signal representing an identical brightness level to data lines during a blanking period to thereby prevent generation of the horizontal stripe phenomenon.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device may for example, include a liquid crystal display panel having gate lines, data lines crossing the gate lines, and liquid crystal cells formed at crossings of the gate and data lines; a liquid crystal display panel driver for driving the gate and data lines, wherein effective pixel signals are applied to the liquid crystal cells during a data apply period and wherein dummy pixel signals have identical brightness levels are applied to the liquid crystal cells during a blanking period.

In one aspect of the present invention, the liquid crystal display panel driver may, for example, include a gate driver for sequentially driving the gate lines during the data apply period; and a data driver for applying the effective pixel signals to the data lines during the data apply period and for applying the dummy pixel signals to the data lines during the blanking period, wherein the data lines are placed in a floating state thereafter.

In another aspect of the present invention, the data driver may convert effective digital pixel data into the effective pixel signals during the data apply period, wherein the effective pixel signals are analog signals; convert dummy digital pixel data into the dummy pixel signals during the blanking period; apply the effective pixel signals during the data apply period; and apply the dummy pixel signals during the blanking period.

In still a further aspect of the present invention, the effective and dummy digital pixel data may be applied from a timing controller, wherein the timing controller controls the gate and data drivers.

In yet another aspect of the present invention, the data driver may invert the polarity of effective pixel signals applied to adjacent ones of data lines during the data apply period; and invert the polarity of dummy pixel signals applied to adjacent ones of data lines during the blanking period.

In still a further aspect of the present invention, the data driver may invert the polarity of effective pixel signals applied to a data line during sequential ones of n horizontal periods (where n is an integer) during the data apply period.

In yet a further aspect of the present invention, the dummy pixel signals applied during the blanking period may include a white signal.

According to principles of another aspect of the present invention, a method of driving a liquid crystal display may, for example, include applying effective pixel signals to data lines of liquid crystal cells within a liquid crystal display panel during an effective data apply period; and applying dummy pixel signals to the data lines during a blanking period, wherein brightness levels of the dummy pixel signals may be substantially identical.

In one aspect of the present invention, the driving method may further include applying dummy pixel signals to the data lines during the blanking period, wherein the data lines are in a floating state thereafter.

In another aspect of the present invention, the polarity of effective pixel signals applied to adjacent ones of data lines may be inverted during the data apply period and the polarity of dummy pixel signals applied to adjacent ones of data lines may be inverted during the blanking period.

In still another aspect of the present invention, the polarity of effective pixel signals applied to a data line during sequential ones of n horizontal periods (n is an integer) during the data apply period may be inverted.

In yet another aspect of the present invention, the dummy pixel signals may be applied as white signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
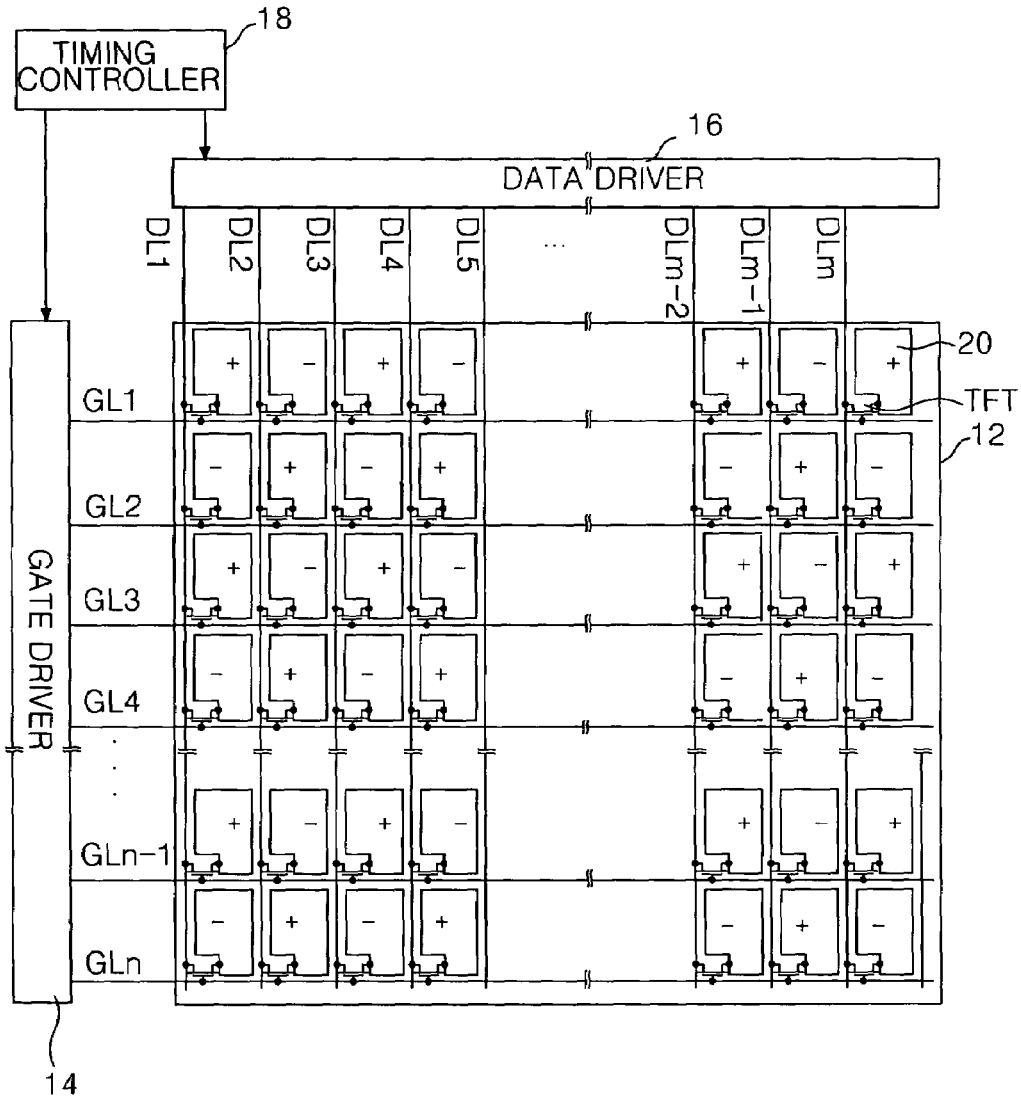
FIG. 1 RELATED ART
FIG. 1 schematically illustrates a related art liquid crystal display (LCD) device.
Figure 2:
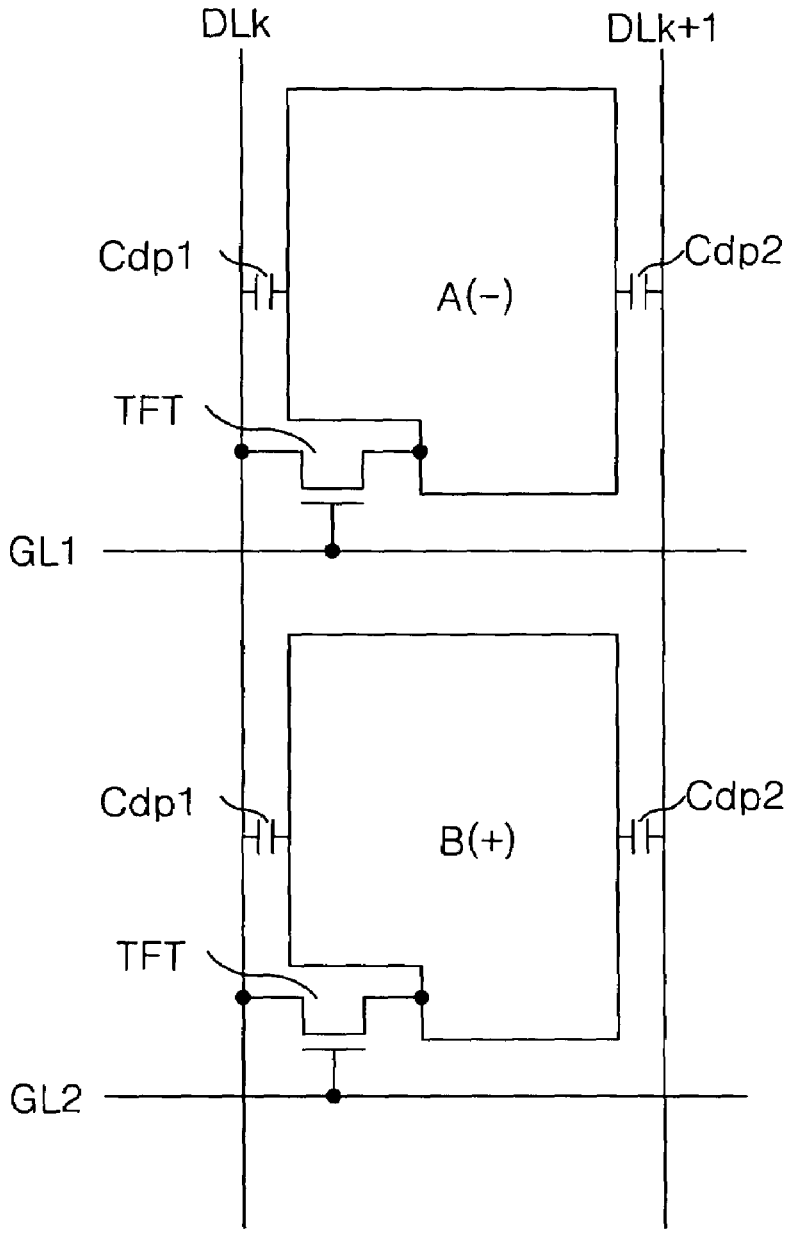
FIG.2 RELATED ART
FIG. 2 illustrates parasitic capacitors of vertically adjacent liquid crystal cells within the related art LCD device shown in FIG. 1.
Figure 3:
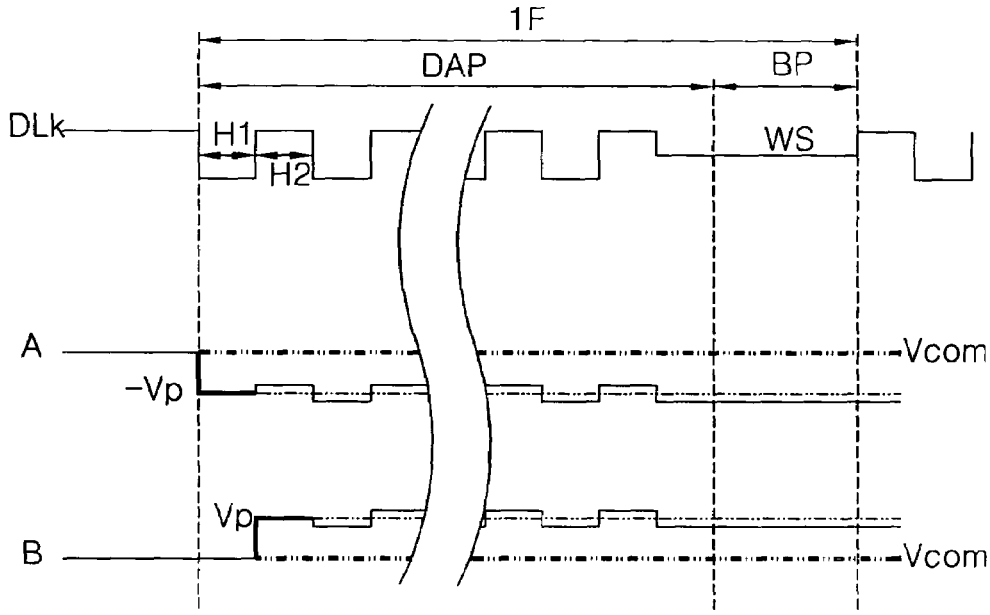
FIG. 3 RELATED ART
FIG. 3 illustrates charging characteristics of vertically adjacent liquid crystal cells with respect to pixel signals applied to the $k^{th}$ data line shown in FIG. 2.
Figure 4:
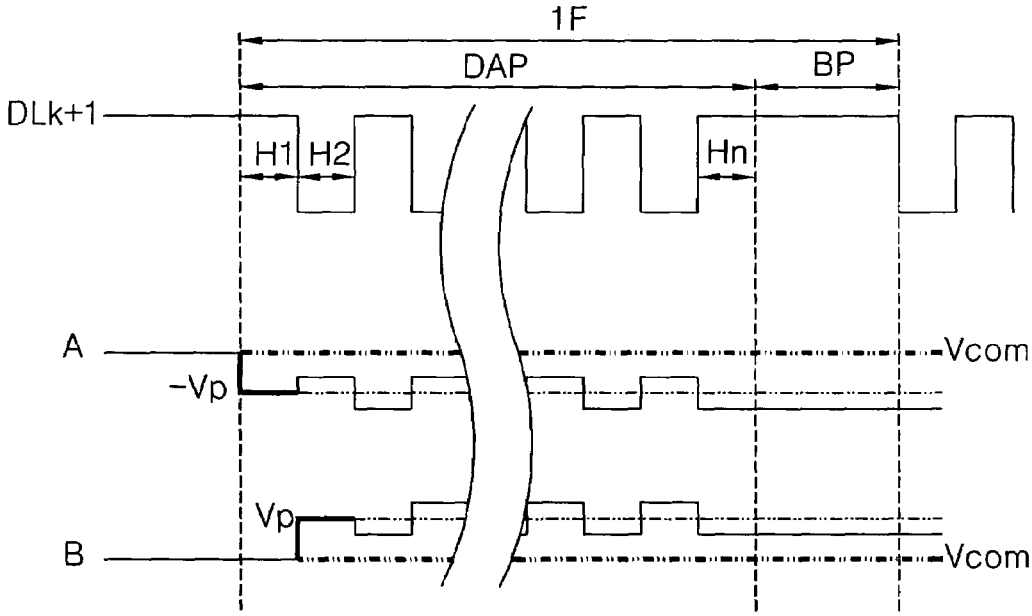
FIG. 4 RELATED ART
FIG. 4 illustrates charging characteristics of vertically adjacent liquid crystal cells with respect to pixel signals applied to the $(k+1)^{th}$ data line shown in FIG. 2.
Figure 5:
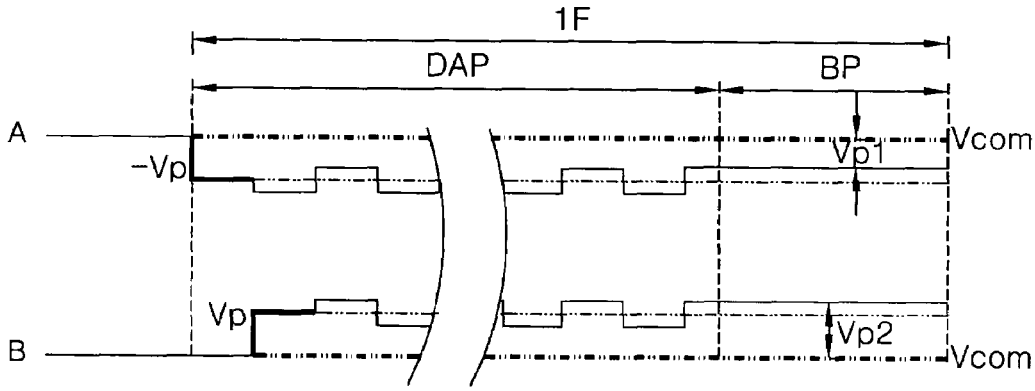
FIG.5 RELATED ART
FIG. 5 illustrates charging characteristics of vertically adjacent liquid crystal cells with respect to pixel signals applied to the $k^{th}$ and $(k+1)^{th}$ data lines shown in FIG. 2.
Figure 6:
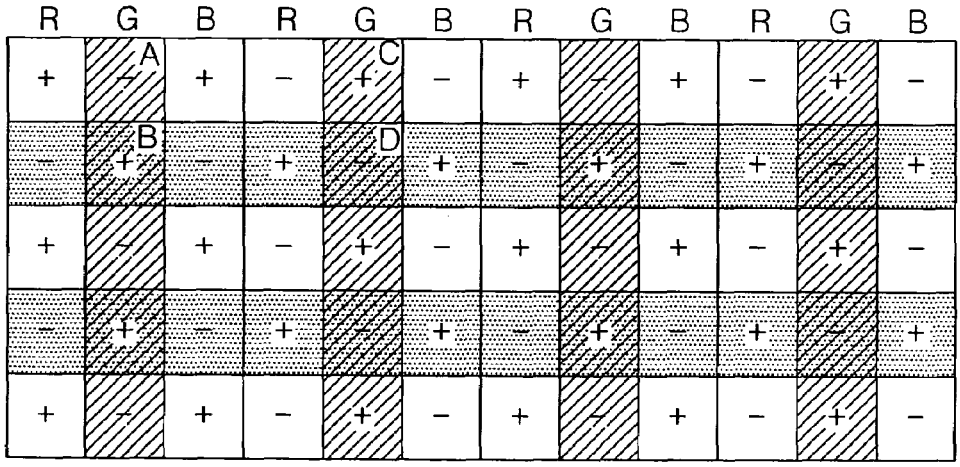
FIG.6 RELATED ART
FIG. 6 illustrates the horizontal stripe phenomenon generated when a predetermined pattern is displayed by the liquid crystal display panel shown in FIG. 1.
Figure 7:
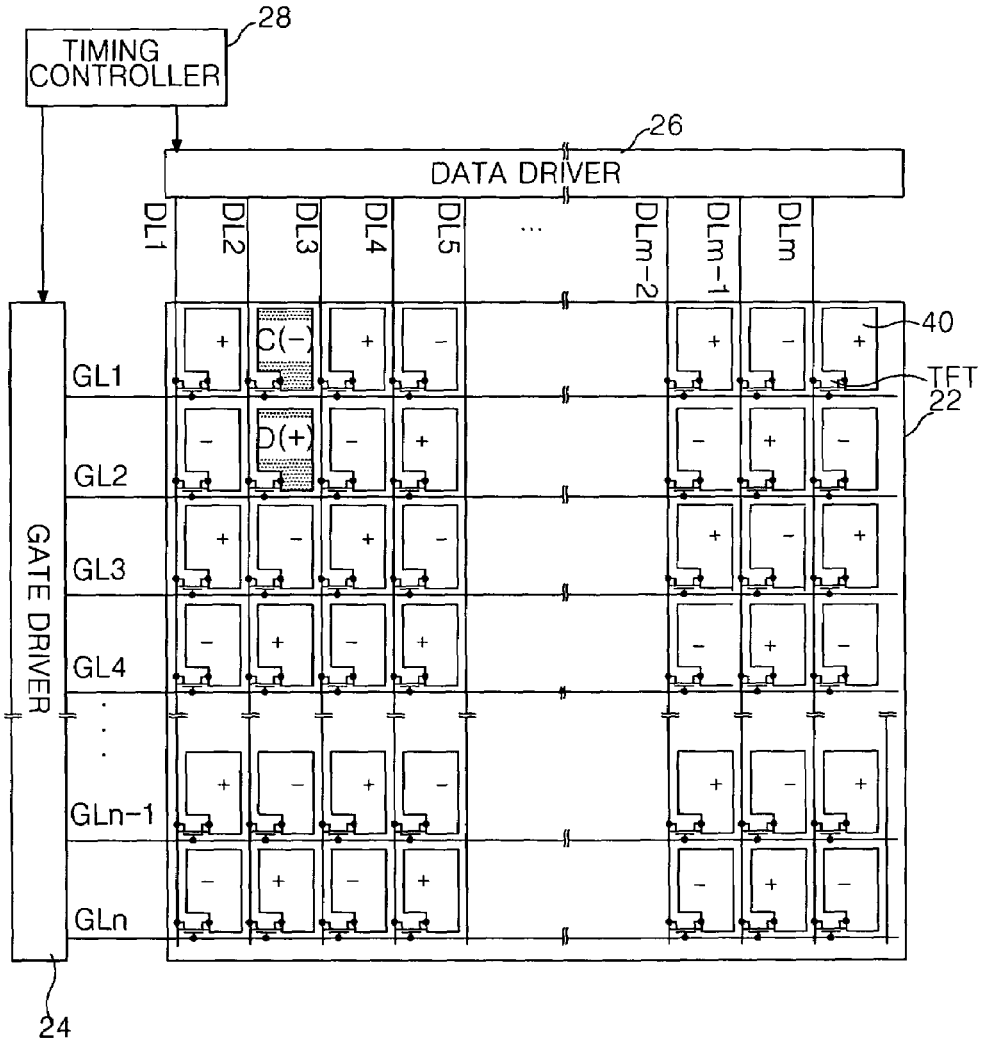
FIG. 7 schematically illustrates an LCD device according to principles of the present invention.

FIG. 7 schematically illustrates a liquid crystal display (LCD) device according to principles of the present invention.

Referring to FIG. 7, the LCD of the present invention may, for example, include an LCD panel 22 having a plurality of liquid crystal cells 30 arranged in a matrix pattern, a gate diver 24 for driving a plurality of gate lines GL1 to GLn, a data driver 26 for applying effective pixel signals to data lines DL1 to DLm during a data apply period (DAP) and for applying dummy pixel signals to data lines DL1 to DLm during a blanking period (BP); and a timing controller 28 for controlling the gate and data drivers 24 and 26, respectively. In one aspect of the present invention, brightness levels of all of the dummy pixel signals may be substantially identical.

The LCD panel 22 may further include a plurality of thin film transistors (TFTs) arranged at crossings of the plurality of gate lines GL1 to GLn and the plurality of data lines DL1 to DLm, wherein each of the plurality of TFTs may be connected to a respective liquid crystal cell 30.

Upon driving the plurality of liquid crystal cells 30, the gate driver 24 may sequentially apply scan signals to the plurality of gate lines GL1 to GLn to sequentially drive rows of liquid crystal cells 30. Accordingly, scan signals may include gate high and low voltages (VGH) and (VGL), respectively. Whenever the gate high voltage (VGH) is applied to a gate line (GL), TFTs within the driven row of liquid crystal cells 30 may be turned on and pixel signals, applied by the data driver 26 applied to each of the data lines DL1 to DLm, are transmitted to the driven row of liquid crystal cells 30. Whenever the gate low voltage (VGL) is applied to a gate line (GL), TFTs within the driven row of liquid crystal cells 30 are turned off, wherein voltages corresponding to the applied pixel signals remain charged within the liquid crystal cells 30.

According to principles of the present invention, each liquid crystal cell 30 may be equivalently represented as a liquid crystal capacitor (Clc) including a common electrode capacitively coupled to a pixel electrode by liquid crystal material having anisotropic dielectric properties, wherein the pixel electrode is connected to a corresponding TFT. Further, each pixel electrode is capacitively coupled to a preceding adjacent data line via a first parasitic capacitor (Cdp1) while each pixel electrode is capacitively coupled to a succeeding adjacent data line via a second parasitic capacitor (Cdp2). In one aspect of the present invention, the conductors of each parasitic capacitor comprise the adjacent data line and the pixel electrode while the insulator of each parasitic capacitor may include an insulating film, air, or the like. Still further, each liquid crystal cell 30 may further include a storage capacitor (Cst) formed between a pixel electrode and a pre-stage gate line, wherein the storage capacitor (Cst) retains a voltage associated with a pixel signal until a subsequent pixel signal is charged to the liquid crystal cell 30. Once a pixel signal is applied from a data line (DL), a turned-on TFT may apply a voltage associated with the pixel signal to the pixel electrode to generate electric field between the pixel and common electrodes. In response to the generated electric field, a molecular orientation of the liquid crystal material may be manipulated such that light transmittance characteristics of the liquid crystal cell may be controlled. Moreover, gray scale values of light may be realized by the liquid crystal cell by adjusting the pixel signal voltage.

According to principles of the present invention, the gate driver 24 may sequentially apply the gate high voltage (VGH) to the plurality of gate lines GL1 to GLn in response to gate control signals (GSP, GSC, GOE) outputted from the timing controller 28. More specifically, the gate driver 24 may generate the shift pulse by shifting a gate start pulse (GSP) in accordance with the gate shift pulse (GSC). Next, the gate driver 24 may apply the gate high voltage (VGH) to a predetermined gate line (GL) during each horizontal period in response to the gate shift pulse (GSC). During operation, the gate driver 24 may apply the gate high voltage (VGH) only during an enable period of a gate output enable signal (GOE). During periods of time when the gate high voltage (VGH) is not applied, however, the gate driver 24 may apply the gate low voltage (VGL) to the gate lines GL1 to GLn.

According to principles of the present invention, the data driver 26 may apply effective pixel signals, specific for each gate line to which the gate high voltage (VGH) is applied, simultaneously to each of the data lines DL1 to DLm during an effective data apply period (DAP) in response to data control signals (SSP, SSC, SOE, POL) outputted by the timing controller 28. More specifically, the data driver 26 may generate a sampling signal by shifting a source start pulse (SSP) in accordance with a source shift clock (SSC) during the data apply period (DAP). Next, the data driver 26 may sequentially receive and latch digital pixel data (R,G,B) outputted from the timing controller 28 in response to the sampling signal. The data driver 26 may then convert the digital pixel data (R,G,B), latched in correspondence with the gate line to which the gate high voltage (VGH) is applied, into analog pixel signals and apply the effective pixel signals to the data lines DL1 to DLm during the enable period of the source output enable signal (SOE). More specifically, the data driver 26 may convert the digital pixel data (R,G,B) into analog pixel signals using gamma signals outputted from a gamma voltage generator (not shown). The data driver 26 may also convert the digital pixel data (R,G,B) into positive and negative pixel signals in response to a polarity control signal (POL). For example, in response to the polarity control signal (POL), the data driver 26 inverts the polarity of the pixel signal based on a columnar arrangement of the liquid crystal cells 40 to drive the liquid crystal display panel 22 according to a dot inversion system.

Further, the data driver 26 may also apply dummy pixel signals simultaneously to each of the data lines DL1 to DLm during a blanking period (BP). In one aspect of the present invention, brightness levels of the dummy pixel signals may be substantially identical. In another aspect of the present invention, the blanking period (BP) may succeed the data apply period (DAP). In still another aspect of the present invention, the dummy pixel signals may, for example, include white pixel signals. In yet another aspect of the present invention, the data driver 26 may receive digital dummy pixel data outputted from the timing controller 28 during the blanking period (BP). The data driver 26 may then convert the digital dummy pixel data into analog dummy pixel signals and apply the dummy pixel signals to the data lines DL1 to DLm. After applying the dummy pixel signals to the data lines, the data lines DL1 to DLm may be induced into a floating state until the next data apply period (DAP) is initiated. In a first alternate aspect of the present invention, however, the data driver 26 may receive the analog dummy pixel signals directly from the gamma voltage generator during the blanking period (BP). In a second alternate aspect of the present invention, a dummy pixel signal generator may be provided to apply analog dummy pixel signals to all data lines DL1 to DLm.

As mentioned above, the timing controller 28 may control the gate and data drivers 24 and 26 by generating the gate control signals (GSP, GSC and GOE) and the data control signals (SSP, SSC , SOE and POL), respectively. Additionally, the timing controller 28 may arrange the digital pixel data (R, G, and B) and applies the arranged digital pixel data to the data driver 26. In one aspect of the present invention, the timing controller 28 may apply dummy pixel data, specific for each gate line to which the gate high voltage (VGH) is applied, to the data driver 26 during the blanking period (BP) if the dummy pixel signals are not generated by data driver 26.

According to principles of the present invention, the LCD display may apply effective pixel signals to the data lines DL1 to DLm during an effective data apply period (DAP) of one frame (1F). Subsequently, the LCD display may apply dummy pixel signals to the data lines DL1 to DLm during a blanking period (BP) of the frame (1F) after which, the data lines DL1 to DLm may be induced into a floating state until the next data apply period (DAP) is initiated in a next frame. According to principles of the present invention, the dummy pixel signals applied to the data lines DL1 to DLm during the blanking period (BP) have substantially identical absolute voltage values, representing substantially identical brightness levels. As a result, the absolute capacitance values of the first and second parasitic capacitors (Cdp1 and Cdp2) within all of the liquid crystal cells 30 of the LCD panel 22 are substantially identical. When the absolute capacitance values of the first and second parasitic capacitors (Cdp1 and Cdp2) are the same for all of the liquid crystal cells 30 within the LCD panel 22, the aforementioned horizontal stripe phenomenon can be substantially prevented from being generated during the blanking period.

Figure 8:
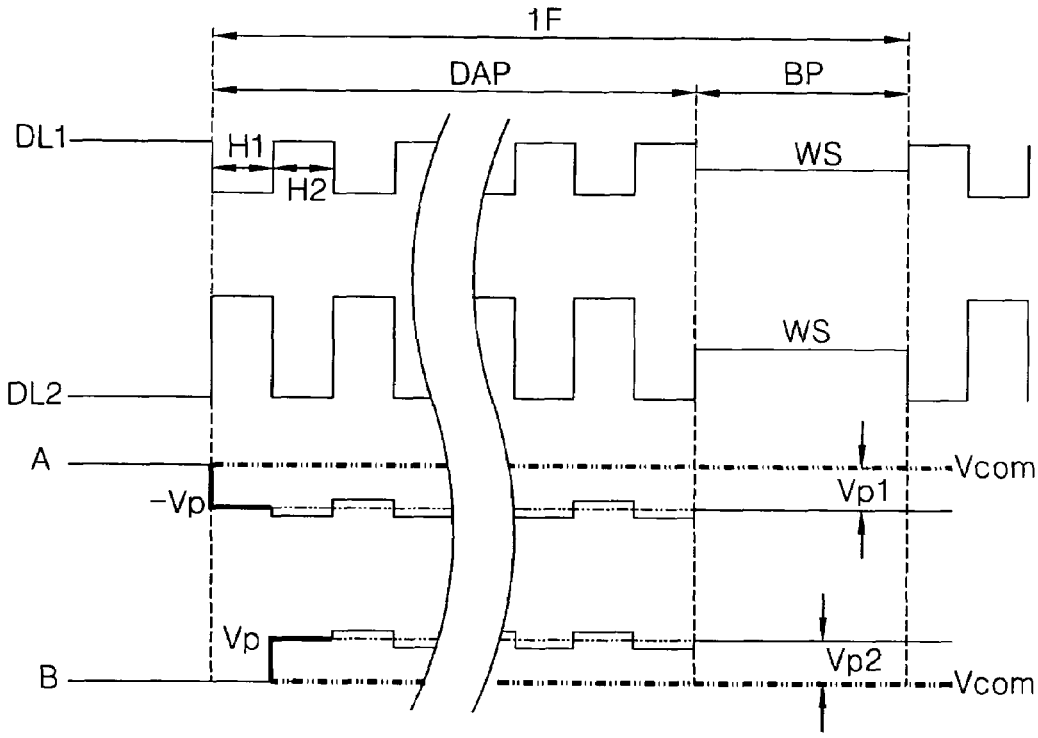
FIG. 8 illustrates charging characteristics of vertically adjacent liquid crystal cells with respect to pixel signals applied to the second and third data lines shown in FIG. 7.

FIG. 8 illustrates charging characteristics of vertically adjacent liquid crystal cells with respect to pixel signals applied to the second and third data lines shown in FIG. 7.

Referring to FIG. 8, during a first horizontal period (H1), a first effective pixel signal (−Vp), having a negative polarity (−) with respect to the common voltage Vcom, may be applied to the second data line (DL2) while a first effective pixel signal (+Vp), having a positive polarity (+) with respect to the common voltage Vcom may be applied to the third data line (DL3). The brightness level represented by the first positive polarity effective pixel signal (+Vp) is relatively higher than the brightness level represented by the first negative polarity effective pixel signal (−Vp). Simultaneously with the application of the first negative and positive polarity effective pixel signals −Vp and +Vp, a first thin film transistor (TFT1), connected to the first gate line (GL1), may be turned on in response to a scan pulse (not shown) applied to the first gate line (GL1). Accordingly, a first negative pixel voltage Vp1, associated with the first negative polarity effective pixel signal (−Vp), may be charged to the first liquid crystal cell (C) connected to the first gate line (GL1) from the second data line (DL2).

Subsequently, during a second horizontal period (H2), a second effective pixel signal (+Vp), having a positive polarity (+) with respect to the common voltage Vcom, may be applied to the second data line (DL2) while a second effective pixel signal (−Vp), having a negative polarity (−) with respect to the common voltage Vcom may be applied to the third data line (DL3). The brightness level represented by the second negative polarity effective pixel signal (−Vp) is relatively higher than the brightness level represented by the second positive polarity effective pixel signal (+Vp). Simultaneously with the application of the second positive and negative polarity effective pixel signals +Vp and −Vp, a second thin film transistor (TFT2), connected to the second gate line (GL2), is turned in response to a scan pulse (not shown) applied to the second gate line (GL2). Accordingly, the second liquid crystal cell (C) is charged the second positive polarity effective pixel signal +Vp via the second data line (DL2). Accordingly, a second positive pixel voltage Vp2, associated with the second positive polarity pixel signal (+Vp), is charged to the second liquid crystal cell (D), connected to the second gate line (GL2), from the second data line (DL2).

As a result of driving the LCD panel 22 as described above, a first negative pixel voltage Vp1 may be capacitively affected by the second positive polarity effective pixel signal (+Vp) applied to the second data line (DL2) via the first parasitic capacitor (Cdp1) arranged between the pixel electrode and the second data line) and by the second negative polarity effective pixel signal (−Vp) applied to the third data line (DL3) via a second parasitic capacitor (Cdp2) arranged between the pixel electrode and the third data line during the second horizontal period (H2). Accordingly, a value of the first negative pixel voltage Vp1 changes during the second horizontal period (H2). Since an absolute value of the second negative polarity effective pixel signal (−Vp) applied to the third data line (DL3) is relatively large, the capacitance of the second parasitic capacitor (Cdp2) is also relatively large, thereby increasing the magnitude of the first negative pixel voltage Vp1 within the first liquid crystal cell (C).

Moreover, during a third horizontal period (H3), a third negative polarity effective pixel signal (−Vp) may be applied to the second data line (DL2) to charge a third liquid crystal cell (not shown) while a third positive polarity effective pixel signal (+Vp) may be applied to the third data line (DL3). The brightness level represented by the third positive polarity effective pixel signal (+Vp) may be relatively higher than the brightness level represented by the third negative polarity effective pixel signal (−Vp). Accordingly, the first negative pixel voltage Vp1 and the second positive pixel voltage Vp2 are both capacitively affected by the third negative and positive polarity effective pixel signals −Vp and +Vp respectively applied to the second and third data lines (DL2) and (DL3), respectively, via the first and second parasitic capacitors Cdp1 and Cdp2, respectively, during the third horizontal period (H3). Since an absolute value of the third positive polarity effective pixel signal +Vp applied to the third data line (DL3) is relatively large, the capacitance of the second parasitic capacitor (Cdp2) is also relatively large, thereby positively decreasing the magnitude of the first negative pixel voltage Vp1 and positively increasing the magnitude of the second positive pixel voltage Vp2.

As can be seen from the discussion above, the various positive and negative polarity pixel signals, charged within each liquid crystal cell, capacitively affect existing positive and negative pixel voltages, previously charged via the second and third data lines (DL2) and (DL3) through the first and second parasitic capacitors Cdp1 and Cdp2 within each liquid crystal cell. Moreover, due to the presence of the aforementioned polarity control signals (POL) applied to the second and third data lines (DL2) and (DL3), the polarity of the capacitance within the parasitic capacitors (Cdp1 and Cdp2) may be inverted during each horizontal period (H). As a result, the various pixel voltages charged within each liquid crystal cell may become offset from each other.

During, for example, the data apply period (DAP) of a first frame (1F), effective pixel signals may be applied to, for example, the second and third data lines (DL2 and DL3) in accordance with the dot inversion method. Due to the aforementioned offset, changes in first and second effective voltage (EVc and EVd) of the first and the second liquid crystal cells C and D, respectively, are substantially the same.

During the blanking period (BP) succeeding the data apply period (DAP), a dummy pixel signal having a negative polarity may be applied to the second data line DL2 while a dummy pixel signal having a positive polarity may be applied to the third data line DL3. In one aspect of the present invention, the negative polarity dummy pixel signal may include a white signal (WS). In another aspect of the present invention, the positive polarity dummy pixel signal may include a white signal (WS). Subsequently, the second and third data lines DL2 and DL3 may be placed into a floating state. According to principles of the present invention, capacitance values of the first and second parasitic capacitors (Cpd1 and Cpd2), arranged within the first and second liquid crystal cells (C and D) and induced by the negative and positive polarity white signals (WS) applied to respective ones of the second and third data lines (DL2 and DL3), are substantially identical to each other, have inverted polarities, and are therefore offset. Since dummy pixel voltages associated with the first negative polarity dummy pixel signal (−Vp) and the second positive polarity dummy pixel signal (+Vp) are substantially identical, substantially no differences exist between the capacitive values of the first and second parasitic capacitors (Cdp1 and Cdp2). Accordingly, changes in the effective pixel voltages EVc and EVd, charged within the first and the second liquid crystal cells (C and D) during the blanking period, remain substantially the same during the blanking period (BP). Accordingly, generation of the horizontal stripe phenomenon may be substantially prevented.

Although the present invention have been described with respect to liquid crystal cells adjacent the second and third data lines and connected to the first and second gate lines, it will readily be appreciated that the principles of the present invention may be extended to all liquid crystal cells similarly arranged within the LCD panel 22. Moreover, and although the LCD display and method of driving the same has been described above in light of the dot inversion method, it will be readily appreciated that the principles of the present invention may be readily extended to a column inversion method where polarities of pixel signals applied to adjacent ones of data lines are inverted, to an N-dot inversion method (N is an integer) where polarities of pixel signals applied between groups of liquid crystal cells are inverted. Regardless of the type of driving inversion method employed, dummy pixel signals representing substantially identical brightness levels may be applied to the data lines during the blanking period. Subsequently, the data lines may be placed into a floating state. Accordingly, deterioration of picture quality due to differences in capacitive coupling between vertically adjacent ones of liquid crystal cells may be prevented.

As described above, dummy pixel signals having substantially identical brightness levels may be provided to all data line during a blanking period. Subsequently, the data lines are placed in a floating state. Accordingly, differences in the effective pixel voltage of vertically adjacent pixels, due to differences in parasitic capacitor coupling between pixel signals charged to liquid crystal cells, can be minimized. As a result, deleterious generation of the horizontal stripe phenomenon may be substantially prevented, thereby improving a picture quality of the LCD device.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

The invention claimed is:

1. A liquid crystal display (LCD) device, comprising:

an LCD panel, the LCD panel including:

a plurality of gate lines;

a plurality of data lines crossing the plurality of gate lines; and a plurality of liquid crystal cells arranged at crossings of plurality of gate and data lines; and a LCD panel driver, wherein effective pixel signals are each appliable to a corresponding one of each of the data lines during a data apply period and wherein dummy pixel signals are each appliable to a corresponding one of each of the data lines during a blanking period following the data apply period, wherein the dummy pixel signals appliable to adjacent one of the data lines have voltage levels identical to each other and have polarities different from each other, during the blanking period of every frame, wherein the dummy pixel signals are applied before the data lines are induced into a floating state during the blanking period.

2. The liquid crystal display (LCD) device according to claim 1, wherein the liquid crystal display panel driver includes:

a gate driver, wherein the plurality of gate lines are sequentially drivable by the gate driver during the data apply period; and a data driver, wherein the effective pixel signals are appliable to the plurality of data lines by the data driver during the data apply period and wherein the dummy pixel signals are appliable to the plurality of data lines by the data driver during the blanking period.

3. The liquid crystal display (LCD) device according to claim 2, wherein the effective pixel signals comprise analog signals converted by the data driver from digital pixel data applied from a timing controller controlling the gate driver and the data driver during the data apply period.

4. The liquid crystal display (LCD) device according to claim 3, wherein the dummy pixel signals comprise analog signals converted from digital dummy pixel data generated by the timing controller, wherein the digital dummy pixel data represents the predetermined brightness level.

5. The liquid crystal display (LCD) device according to claim 2, wherein polarities of effective pixel signals appliable to adjacent ones of data lines are invertable by the data driver during the data apply period.

6. The liquid crystal display (LCD) device according to claim 2, wherein polarities of effective pixel signals appliable to the plurality of data lines during sequential ones of horizontal periods are invertable by the data driver during the data apply period.

7. The liquid crystal display (LCD) device according to claim 2, wherein the dummy pixel signals comprise a white signal.

8. A driving method of a liquid crystal display (LCD) device, comprising:

applying a plurality of effective pixel signals to a plurality of liquid crystal cells via a plurality of data lines during a data apply period; and applying dummy pixel signals to the plurality of data lines during a blanking period following the data apply period, wherein the dummy pixel signals are each applied to a respective one of the data lines; and inverting polarities of the dummy pixel signals representing the predetermined brightness level applied to adjacent ones of the plurality of data lines during the blanking period, wherein the dummy pixel signals applied to the data lines have substantially the same voltage level wherein the dummy pixel signals applied to adjacent ones of the data lines have different polarities during the blanking period of every frame, wherein the dummy pixel signals are applied to the data lines are induced into a floating state during the blanking period.

9. The driving method according to claim 8, further comprising inverting polarities of effective pixel signals applied to adjacent ones of the plurality of data lines during the data apply period.

10. The driving method according to claim 8, further comprising inverting polarities of effective pixel signals applied to the plurality of data lines during sequential ones of horizontal periods during the data apply period.

11. The driving method according to claim 8, further comprising applying the dummy pixel signals as white signals.

12. A method of driving a liquid crystal display (LCD) panel over a plurality of successive frame periods, wherein each frame period includes a data apply period and a blanking period, the method of driving comprising:

applying a plurality of effective pixel signals to n rows of liquid crystal cells of the LCD panel during the data apply period;

applying a plurality of dummy pixel signals to each of a respective one of a plurality of data lines within the LCD panel during the blanking period; and floating the plurality of data lines within the LCD panel during the blanking period, wherein the dummy pixel signals applied to the data lines have voltages identical to each other and have polarities different from each other during the blanking period of each frame, wherein the dummy pixel signals are applied before the data lines are induced into a floating state during the blanking period.

13. The method of driving a liquid crystal display (LCD) panel of claim 12, wherein the plurality of dummy pixel signals comprise a predetermined voltage value.

14. The method of driving a liquid crystal display (LCD) panel of claim 13, wherein the plurality of dummy pixel signals comprise white signals.

15. The method of driving a liquid crystal display (LCD) panel of claim 12, further comprising inverting polarities of effective pixel signals applied to adjacent ones of the plurality of data lines during the data apply period.

16. The method of driving a liquid crystal display (LCD) panel of claim 12, further comprising inverting polarities of effective pixel signals applied to the plurality of data lines during sequential ones of horizontal periods during the data apply period.

* * * * *